United States Patent [19]

McIntosh

[11] 4,379,546

[45] Apr. 12, 1983

[54] LIFTING JACK

[75] Inventor: Thomas K. McIntosh, Bloomfield, Ind.

[73] Assignee: Bloomfield Manufacturing Co., Inc., Bloomfield, Ind.

[21] Appl. No.: 226,072

[22] Filed: Jan. 19, 1981

[51] Int. Cl.[3] ..... B66F 1/04

[52] U.S. Cl. ..... 254/111

[58] Field of Search ..... 254/105–111, 254/126; 74/42, 141.5

[56] References Cited

U.S. PATENT DOCUMENTS

| | | | |
|---|---|---|---|
| D. 248,460 | 7/1978 | Dunn et al. . | |
| 1,307,968 | 6/1919 | Harrah . | |
| 1,374,653 | 4/1921 | Harrah . | |
| 1,482,846 | 2/1924 | Harrah . | |
| 1,822,969 | 9/1931 | Johnson | 254/111 |
| 2,786,650 | 3/1957 | Bottorff | 254/105 |
| 3,588,046 | 6/1977 | Weaver | 254/110 |
| 4,055,329 | 10/1977 | Hammond | 254/126 |

*Primary Examiner*—Robert C. Watson

*Attorney, Agent, or Firm*—Woodward, Weikart, Emhardt & Naughton

[57] ABSTRACT

A lifting jack for lifting loads and exerting a pulling force between two locations includes an I-beam standard having a series of uniformly shaped and evenly spaced apertures, an upper runner disposed about the standard and carrying a first climbing pin which is adapted to fit within a corresponding one of the various apertures, a lower runner disposed about the standard and carrying a second climbing pin also adapted to fit within a corresponding one of the various apertures. The upper and lower runners are connected together by a pitman and these three components are further assembled to a lever which is pivotally attached so as to provide a jacking action to the upper and lower runners. The lever has a pair of fulcrum points only one of which is used with any one jacking cycle, depending upon which runner is advancing and which climbing pin is to be inserted into a corresponding aperture. The pitman is arranged into a single-piece, U-shaped lateral cross-section configuration providing greater strength and durability at a very critical point in the construction. A reversing switch and reversing latch combination are arranged relative to the upper and lower runners so that the direction of movement of these runners may be reversed.

7 Claims, 12 Drawing Figures

LIFTING JACK

BACKGROUND OF THE INVENTION

This invention relates in general to jack designs and in particular to lifting jacks employing a pair of climbing pins.

Lifting jacks of the type employing climbing pins have been known in the art for many years. Early patents disclosing such structures date back as far as the early 1900's, and while various improvements have been made over the years, many aspects of this type of structure which employs a pair of runners, have remained substantially unchanged over the years. The design concept includes a standard with a series of spaced apertures and a pair of climbing pins which alternately fit into these apertures as their corresponding runners move along the standard in a step-by-step fashion which is controlled by a handle (lever) member. A reversing mechanism enables the runners to be moved along the standard, intermittently in either direction.

The following listed patents are generally typical of the above style of lifting jack.

| Pat. No. | Patentee | Issue Date |
|---|---|---|
| 1,307,968 | Harrah | 6/24/19 |
| 1,374,653 | Harrah | 4/12/21 |
| Des. 248,460 | Dunn et al. | 7/11/78 |
| 1,482,846 | Harrah | 2/05/24 |

Harrah ('968) discloses a lifting jack designed and arranged so that the lowering action as well as the lifting movement is effected in a step-by-step manner. To accomplish this objective, the disclosed structure includes a standard having a plurality of perforations and a pair of runners movable on the standard. Each of the runners is provided with a spring-actuated pin adapted to be projected into a corresponding perforation. An operating lever mechanism causes the runners to alternately move along the standard and a reversing plate enables movement of the runners in the opposite direction.

Harrah ('653) discloses a lifting jack which is intended to be an improvement over U.S. Pat. No. 1,307,968, yet is quite similar in that its structure includes a standard formed with holes and a pair of runners which are movable along the standard. Each of these runners is equipped with a spring-actuated pin for alternately entering the holes of the standard in order to constitute a fixed stop while the other runner is advancing. A lever mechanism enables movement of the runners along the standard. This particular patent reference is intended to be an improvement to the earlier patent by enhancing the strength and efficiency of the device. A related improvement is that the nose or step of the jack is allowed to approach quite closely to ground and thus enables the particular jack disclosed to get under loads which are disposed very low to the ground level.

Dunn et al. discloses a jack which employs the dual-runner, dual-pin concept for advancing the nose of the jack along a perforated standard. Although this particular patent is a design patent, the general external appearance of the component parts may provide the closest reference to the present invention.

Harrah ('846) discloses a pole pusher and while some of this structure may be unrelated to the present invention, the mechanism which accounts for movement of cylinder 24 relative to base 22 is the same as that disclosed in U.S. Pat. No. 1,374,653. This mechanism employs a dual-pin concept, the pins being insertable into holes in the standard, a handle to move the runners along the standard in a step-by-step manner, and a reversing mechanism for changing the direction of movement of the runners relative to the standard.

One of the improvements over the general state of the art provided by an early patent (U.S. Pat. No. 1,307,968) was to permit the lowering action to be accomplished in a step-by-step manner. A later patent (U.S. Pat. No. 1,374,653) provided the improvements of greater strength and efficiency, a novel manner of mounting the hand lever and the relative configurations and positions of the runners. By revising the runner configurations, the nose (step) of the jack is placed close to the ground and is better able to get beneath low loads.

While there may be other improvements possible as new and varied uses are found for this type of lifting jack, one type of improvement provided by the present invention is a revision in the style and configuration of the various component parts which are assembled together in order to provide greater strength and durability with a more efficient method of fabrication, and lower cost.

Since the patentability of an article of manufacture is based upon its novelty and utility, it is not sufficient that a claimed article merely be different from prior art articles. The claimed article must also have utility, and in the case of related articles, it must be novel and a useful improvement over the prior art. Usefulness (utility) has been found in inventions which provide improvements in safety, are more convenient to use, are more efficient, are more durable and less expensive. Consequently, when a component part of a larger apparatus is changed and this change is claimed as part of a patent application, the change must satisfy one of the above criteria in order to provide utility and thus be classified as "useful." When a component part is restyled so that it is less expensive to manufacture, or stronger, or easier to assemble or use, utility for the claimed invention exists even though the external appearance of the component part may seem similar to a corresponding component part in a prior art apparatus.

The disclosed and claimed lifting jack of the present invention incorporates a number of component parts which represent improvements over corresponding component parts of the above-listed patent references. In certain instances, the component parts may be stampings, and in other instances they may be castings. In each instance where a part has been redesigned to provide additional utility and is an improvement to earlier designs, its specifics as to manufacturing and reconfiguration are described in detail.

SUMMARY OF THE INVENTION

A lifting jack for lifting loads in a step-by-step manner according to one embodiment of the present invention comprises a standard having a plurality of spaced apertures, an upper runner disposed about the standard, a first pin carried by the upper runner and adapted to fit within the apertures, a lower runner disposed about the standard, a second pin carried by the lower runner and adapted to fit within the apertures, lever means pivotally attached to the upper runner for moving the upper runner along the standard, a pitman pivotally attached at a first end to the lever means and at a second end to the lower runner thereby cooperatively coupling the upper and lower runners together, movement of the upper and lower runners including alternately positioning the first and second pins into the apertures, the pitman being of a single piece, U-shaped lateral cross-sectional configuration, and reversing means for changing the direction of movement of the upper and lower runners from a first direction to a second direction opposite to the first direction.

One object of the present invention is to provide an improved lifting jack.

Related objects and advantages of the present invention will be apparent from the following description.

DESCRIPTION OF THE PREFERRED EMBODIMENT

Figure 1:
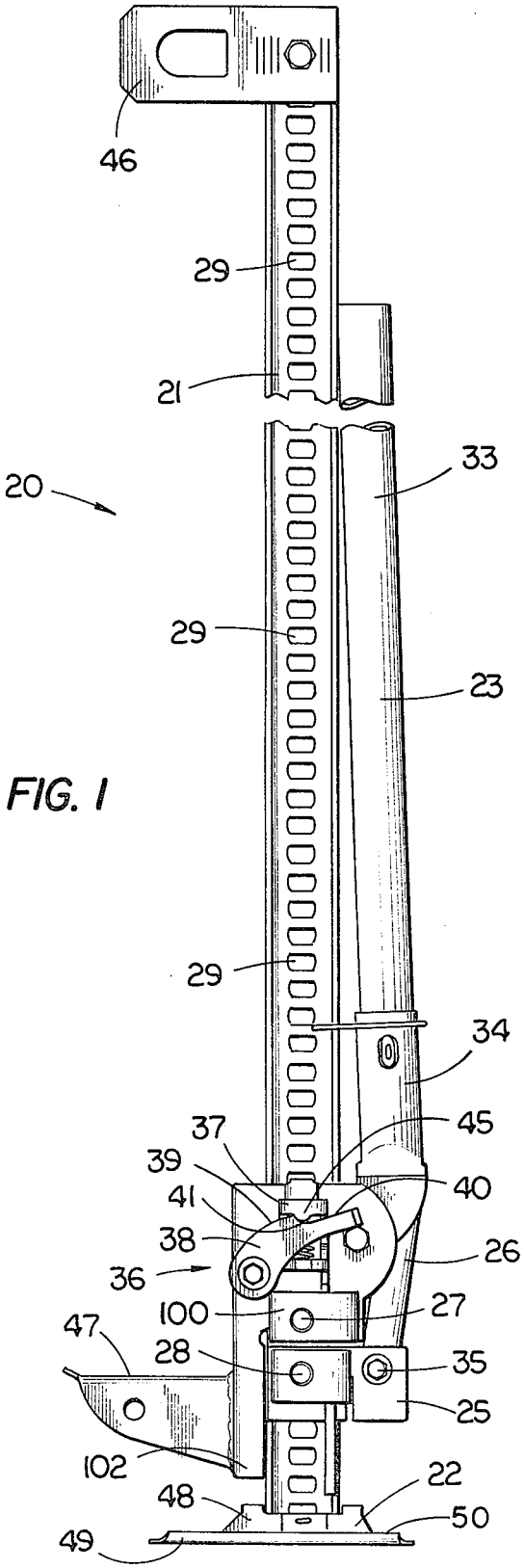
FIG. 1 is a side elevation view of a lifting jack according to a typical embodiment of the present invention.
Figure 2:
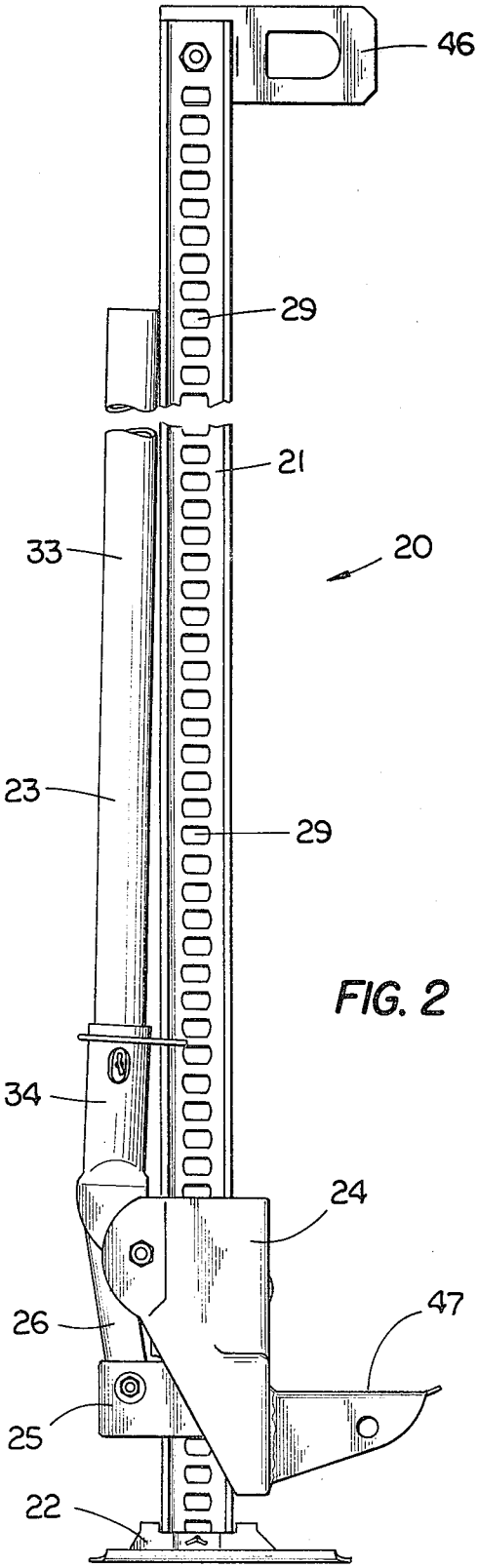
FIG. 2 is a side elevation view of the FIG. 1 lifting jack opposite to the view of FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIGS. 1–4, there is illustrated a lifting jack 20 of the style, which by way of a hand lever advances a pair of runners along a standard by means of alternately inserting one of two pins into receiving apertures disposed within the standard.

Lifting jack 20 includes standard 21, base 22, lever 23, upper runner 24, lower runner 25, pitman 26, first pin 27 and second pin 28. Disposed within standard 21 is a plurality of uniformly shaped and evenly spaced apertures 29 which are adapted to receive in an alternating fashion first pin 27 and second pin 28. Lever 23 includes a handle 33 and a handle socket 34 and the hinged end of socket 34 is pinned at a first location to one end of pitman 26 and is pinned at a second location to the upper runner 24. The opposite end of the pitman 26 is pinned to lower runner 25 at location 35. As handle 33 is moved up and down in a jacking action, the linkage arrangement of socket 34, pitman 26, upper runner 24 and lower runner 25 is such so as to move the upper and lower runners along the standard. Since first pin 27 and second pin 28 are each spring-biased and directed toward apertures 29, the movement of upper runner 24 and lower runner 25 moves, in an alternating fashion, these two pins into direct alignment with one of the apertures 29. When such alignment is achieved, the particular pin involved is spring-biased to insert into this corresponding aperture. The other pin is positioned in such a manner that it makes pressure contact against that portion of the standard between apertures. Each pin has a beveled surface which is inward and outwardly facing relative to the standard such that as handle 33 is manipulated, the pin not in engagement with an aperture is raised into engagement and subsequently the engaged pin is drawn out of engagement. The alternating insertion and removal of the pins from the apertures allows the runners to advance along the standard in an alternating step-by-step fashion. U.S. Pat. No. 1,374,653 issued Apr. 12, 1921 to Harrah and assigned to the assignee of the present invention discloses in some detail the alternating insertion action of the pair of climbing pins and this particular patent is hereby incorporated by reference for its disclosure of the climbing pin movement and corresponding structure.

By means of reversing mechanism 36, the direction of movement of the runners relative to the standard is controlled. Reversing mechanism 36 includes reversing switch 37 and reversing latch 38. The top edge of reversing latch 38 is configured into an outermost portion 39 and a recessed portion 40 with a curved interface 41 therebetween. With the downwardly directed protuberance 45 of reversing switch 37 abutting curved interface 41 (as illustrated in FIG. 1), the upper and lower runners move upwardly toward top handle 46. However, when reversing latch 38 is tripped so that protuberance 45 rides against outer portion 39, the upper and lower runners move downwardly toward base 22. Such downward movement still occurs by means of jacking action on handle 33 and the alternate withdrawal of the pins from apertures 29.

Nose (step) 47 provides one lifting concept for lifting jack 20. As should be familiar, such a nose may be used beneath the bumper or frame of a vehicle in order to raise the vehicle a sufficient distance for repair work underneath or changing a tire. The disclosed lifting jack may also be suitable to raise a jeep or truck out of soft ground so that a firmer material may be placed beneath the tires and allow the vehicle to be driven away. The combined use of nose 47 and top handle 46 in combination with wire rope or cable allows the disclosed lifting jack to be used as a "come-along" and is capable of pulling approximately 5,000 pounds dead weight a distance of about 40 inches. This distance may be increased or decreased, depending upon the length of the standard which is utilized with the particular lifting jack. In this regard, it should be understood that the standard has an I-beam shape and in the exemplary embodiment it is constructed of steel. Its particular shape allows it to be inserted into the raised channel portion 48 of base 22.

While a fairly adequate and accurate description of the climbing pin movement is provided by means of U.S. Pat. No. 1,374,653, a fairly detailed illustration of the current style of lifting jack, in a somewhat broad or general manner, is provided by means of U.S. Pat. No. Des. 248,460, issued July 11, 1978 to Dunn et al. and which is hereby incorporated by reference. The illustrated jack construction of this design patent represents a current prior art lifting jack concept and reference to this design patent is important in order to have a full appreciation for the differences between the prior art styled lifting jack and the revised and improved construction and style of the present invention.

The fabrication and construction of the lifting jack disclosed in U.S. Pat. No. Des. 248,460 involves a variety of component piece parts, many of which are machined or made from stampings. When a variety of component parts are made from stampings and then welded together into a finished component part, there are naturally concerns regarding the fabrication time and expense and the strength and durability of the finished part. Since individual machining of component piece parts can be quite time consuming and expensive, a more rapid production concept is to stamp the various pieces and form them into the desired contour after stamping. While this particular fabrication concept represents cost efficiencies, the strength and durability of the finished part may be suspect. Further, there are certain limitations as to what may be stamped and the permissible bending or forming operations ater stamping. Quite often, in order to construct a complicated part, various stampings must be produced and then welded together or otherwise assembled. Since welding time and subsequent clean-up represent significant expense items, it is desirable to make any welding which may be required as simplified as possible and to minimize the amount of weld required.

Another fabrication technique which oftentimes results in more durable piece parts is a casting operation. Although castings can represent a high cost for small quantities, large volume sand castings can be very efficiently utilized in order to produce very strong and durable parts, even though the component piece parts may be of a complicated design.

The lifting jack disclosed by U.S. Pat. No. Des. 248,460 while providing a number of improvements over earlier lifting jacks, offers yet additional areas for improvement as to its fabrication expenses and the overall strength and durability of the lifting jack. One set of lifting jack improvements is illustrated in FIGS. 1–4. Lifting jack 20 which is disclosed by these four figures, is referred to as a "stamping jack" in that virtually all of the component piece parts which are of importance to the novelty of the present invention are made by stamping operations and then formed into their finished shape. A number of design changes have been made to those earlier jacks which were also produced with stampings so that welding time and subsequent finishing operations are minimized. Additionally, the various stamping component piece parts have been redesigned in several instances to provide a more durable component piece part concept.

The lifting jack illustrated in FIGS. 7–10 can be classified as a combination jack in that there is a mixture of stamped component piece parts and cast component piece parts. With this one exception, the construction and operation of lifting jack 60 (FIGS. 7–10) is identical to that of lifting jack 20 in that a jacking action of the lever accounts for travel along the standard of upper and lower runners, with step-by-step movement, by means of alternating climbing pins. In order to simplify the comparison between lifting jack 60 and lifting jack 20, all reference numerals between numbers 60 and 88 coincide with reference numerals 20–48, there being a uniform numerical difference of 40 for each corresponding component piece part of the two lifting jack designs. With this understanding of the similarities between lifting jack 60 and lifting jack 20 and an appreciation as to generally how these lifting jacks differ from the prior art lifting jacks, a more detailed discussion will now follow regarding specific differences and changes and the improvements and benefits provided by each of these changes.

One set of improvements involves the construction of the base, the handle socket, the pitman, the reversing latch and the reversing switch. Inasmuch as these five component piece parts are identical in the FIG. 1 lifting jack and the FIG. 7 lifting jack, the improvements to the prior art will be described relative only to lifting jack 20, as illustrated in FIGS. 1–4, the same improvements being applicable to lifting jack 60.

Figure 6:
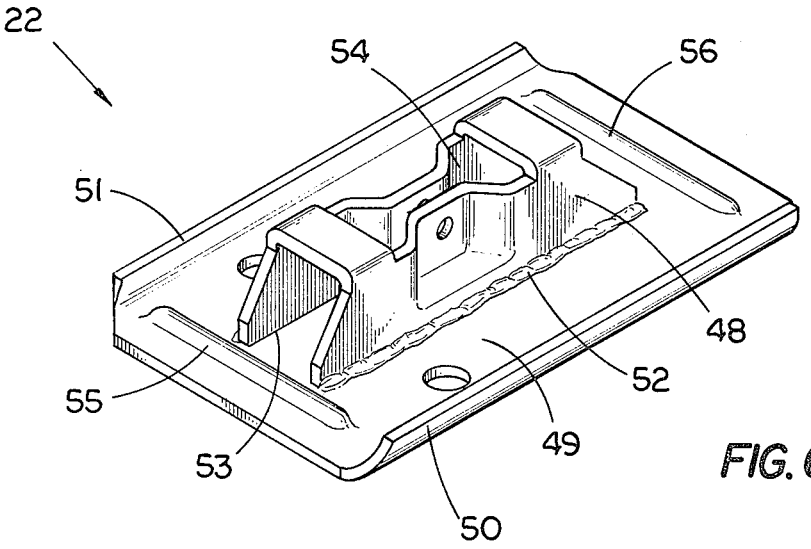
FIG. 6 is a perspective view of a base member comprising a portion of the FIG. 1 lifting jack.
Figure 7:
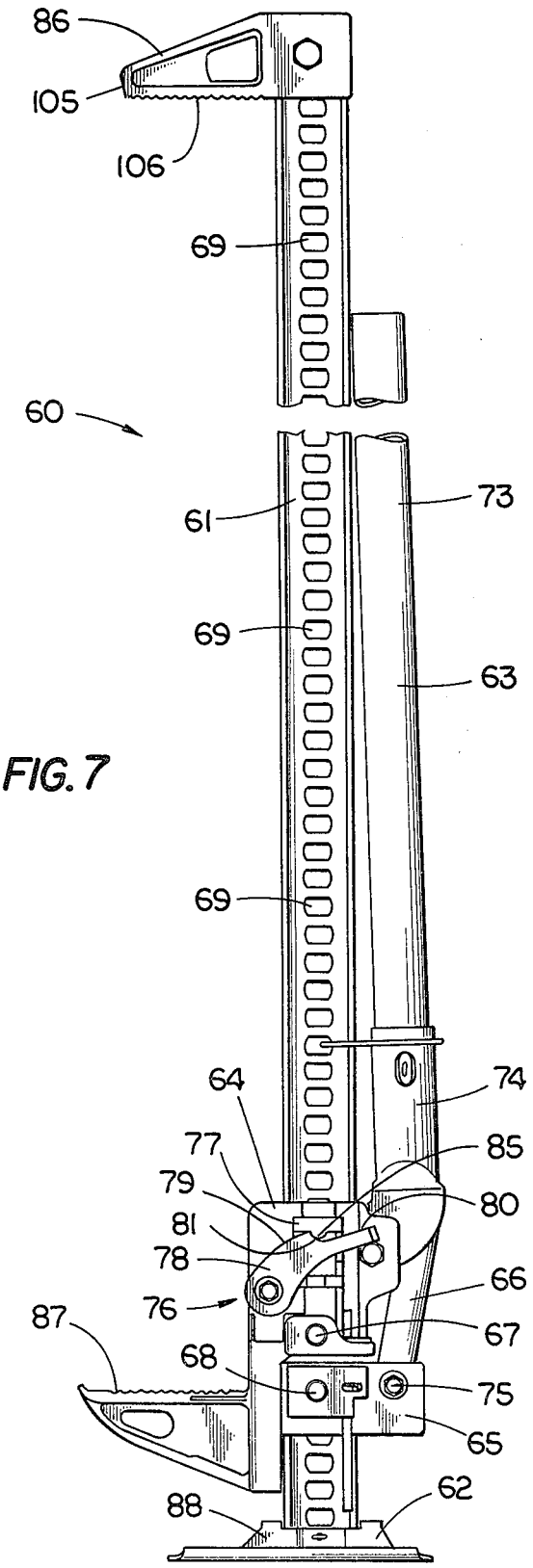
FIG. 7 is a side elevation view of a lifting jack according to a typical embodiment of the present invention.
Figure 8:
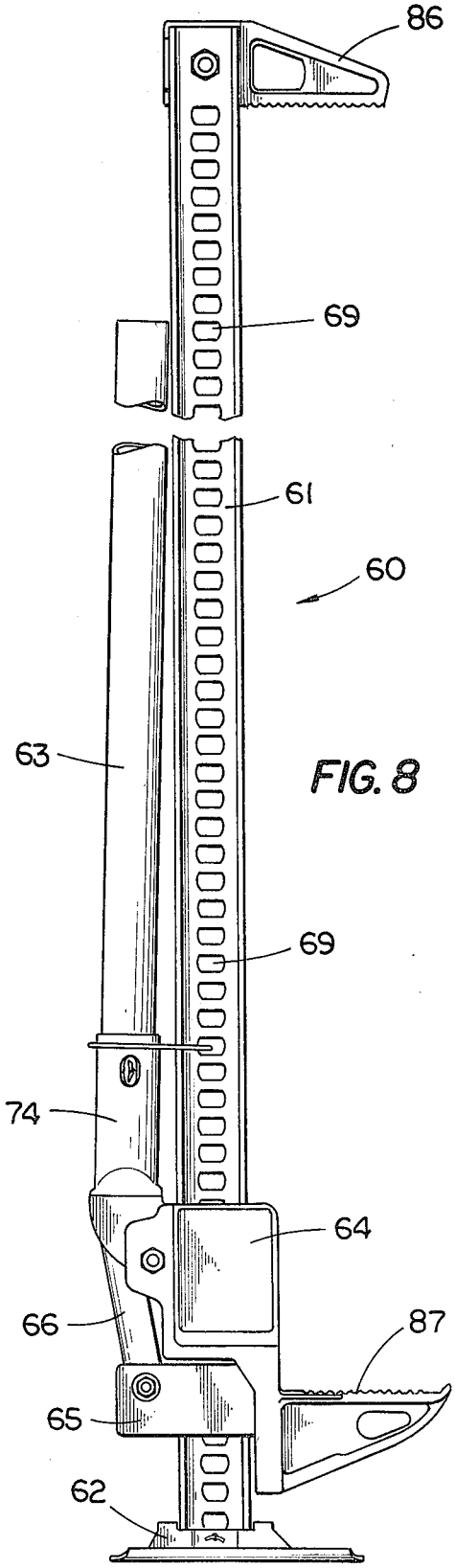
FIG. 8 is a side elevation view of the FIG. 7 lifting jack opposite to the view of FIG. 7.
Figure 9:
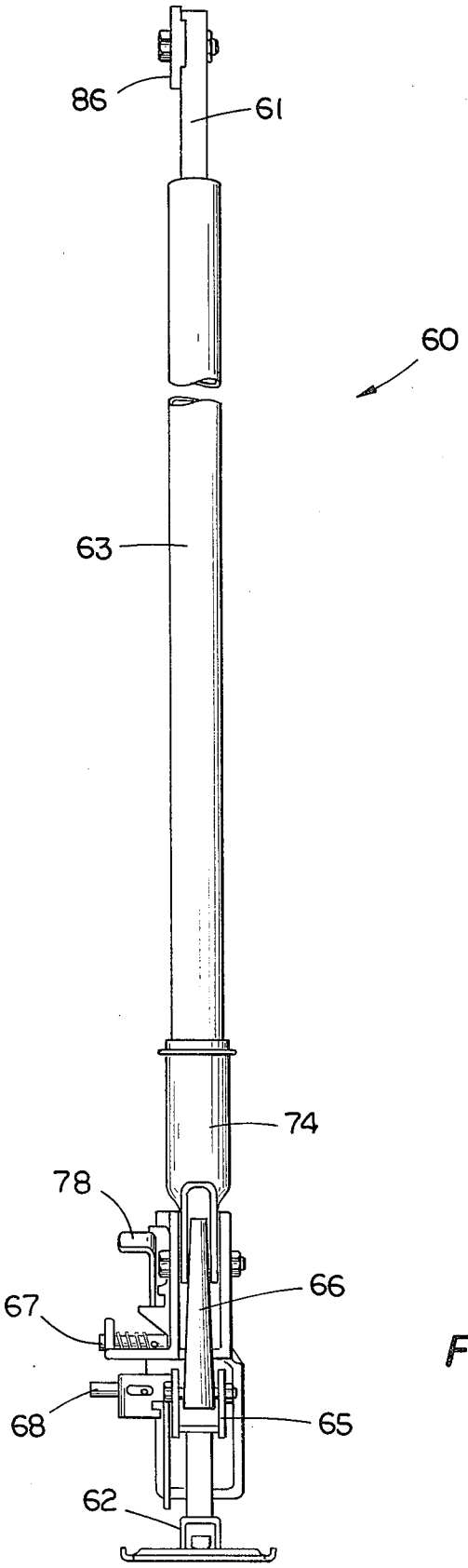
FIG. 9 is a rear elevation view of the FIG. 7 lifting jack.
Figure 10:
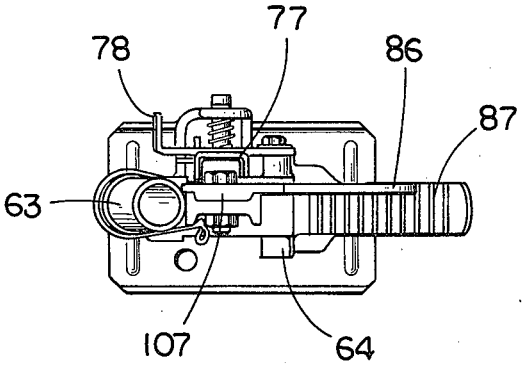
FIG. 10 is a top plan view of the FIG. 7 lifting jack.
Figure 11:
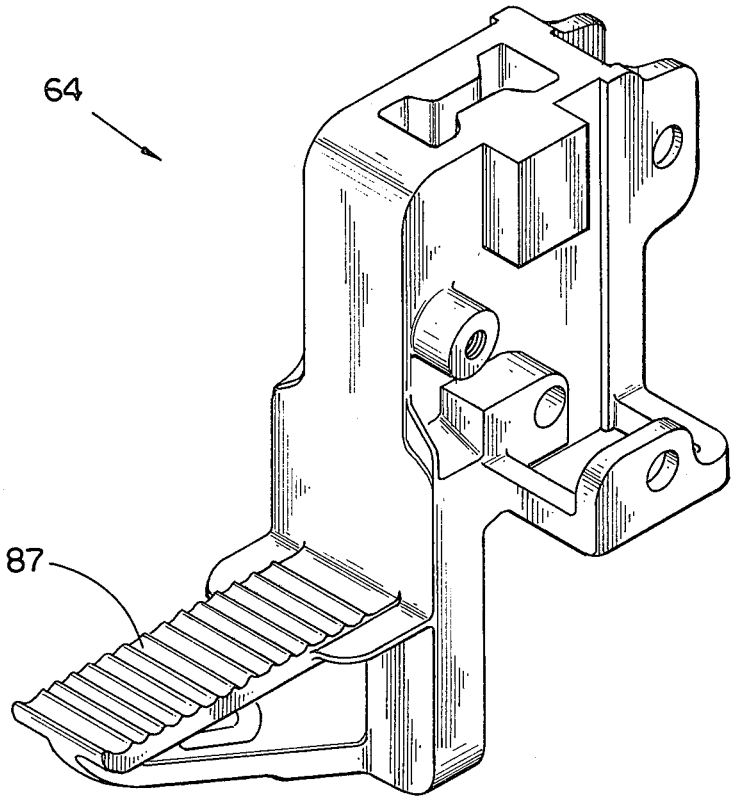
FIG. 11 is a perspective view of an upper runner comprising a portion of the FIG. 7 lifting jack.

Base 22 (see FIG. 6) includes a raised channel portion 48 which is welded to a substantially flat platform 49. The side edges 50 and 51 of platform 49 are upturned for additional strength and rigidity. However, the more significant revision from the prior art design is to configure raised channel portion 48 such that its two lower edges 52 and 53 are substantially straight throughout their entirety. It is these two edges which are placed in direct contact with the top surface of platform 39 and along which weld is applied in order to securely attach raised channel portion 48 onto platform 49. In the prior art construction, as represented by U.S. Pat. No. Des. 248,460, these side edges of the raised channel portion were intricately curved and flared so as to provide a very irregular welding line. Since a straight weld is infinitely more economical to make, the revised design for base 22 is an improvement over the prior art in that it is more efficient to fabricate. In order to provide a snug fit for standard 21 within raised channel portion 48, opening 54 must be contoured in a manner so as to fit snugly around standard 21. In the prior art, the entire side wall of the raised channel portion was contoured in order to provide this fit and the flared ends of these side walls provided additional stability and strength to the base. By the improved redesign of base 22, the contour to opening 54 is still provided, but the welding line remains straight for efficiency in fabrication. Since the flared ends of the prior art are eliminated by this concept, additional strength and rigidity are provided by the upturned side edges 50 and 51 and by means of stiffening ribs 55 and 56.

In the prior art, handle socket 34 was fabricated by means of two half shell pieces which were then drawn together and welded along two full-length, opposite seams. The lower flanged portion of the prior art handle socket also included two inside embossments which were required in order to taper down the overall part thickness from that required for the handle to that required for the pitman. By revising the design of the pitman so that it is, as disclosed by the new design, thicker than it was in the prior art arrangement, these inside embossments are eliminated thus simplifying the part.

The new design for handle socket 34 involves a single-piece construction in lieu of a two-piece construction. This then eliminates the seam on the outer surface and disposes the only seam for the part on the inside surface which is directed at the standard in the illustrated orientation of FIG. 1. Since a majority of the force of the jacking action caused by handle 33 is directed at the outer surface, the elimination of a seam and weld at that point enhances the strength of the part. Further, by disposing the only seam at an inwardly facing surface, the appearance of the handle socket is improved. A further advantage of one-piece construction is that the handle socket 34 is produced in one die operation where before, the two halves had to be made separately and jig-welded together.

Figure 3:
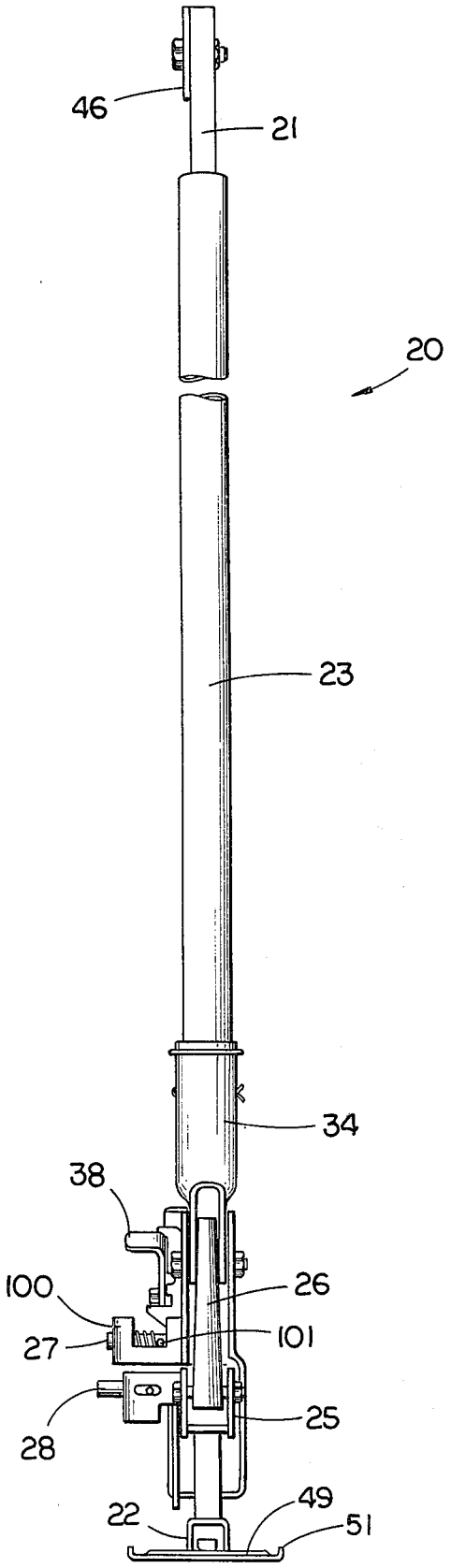
FIG. 3 is a rear elevation view of the FIG. 1 lifting jack.
Figure 4:
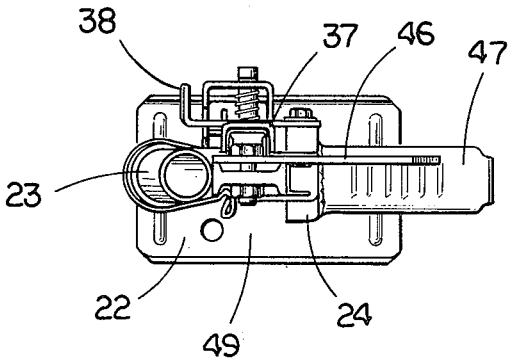
FIG. 4 is a top plan view of the FIG. 1 lifting jack.

As was previously mentioned, the pitman 26 has been revised and its revised construction can best be illustrated by FIG. 3. FIG. 3 taken in combination with FIG. 1 should clearly illustrate that pitman 26 is a single-piece formed member which has a generally U-shaped lateral cross section throughout its entire length. Although coupled to the socket 34 at a first end and to the lower runner 25 at a second, opposite end, the pitman has a narrowing taper from the second end to the first end. The old pitman design involved two pieces with facing surfaces welded together and a type of wishbone configuration at its lowermost end. Again, the fabrication time for two individual piece parts which had to be welded together was excessive, and represented considerable cost. By going to a single-piece construction, a die-formed part is available which provides greater strength, uniform thickness throughout its entire length, and eliminates the need for any welding or clean-up. Further, by the increased thickness, the embossments previously required for the handle socket are eliminated. Thus, this particular combination of piece parts together represents a cost savings and a significant design improvement. Pitman 26 is stamped (die-formed) as a single piece and then formed into its U-shaped configuration. This is accomplished through a series or progression of steps as is well known in the art. The design of the prior art, which had the wishbone-like shape at its lowermost end, would tend to buckle or bend in the area of this wishbone-shape and the improvement offered by the present invention enables softer material to be used and still do the same job without the pitman part bending or buckling.

Figure 12:
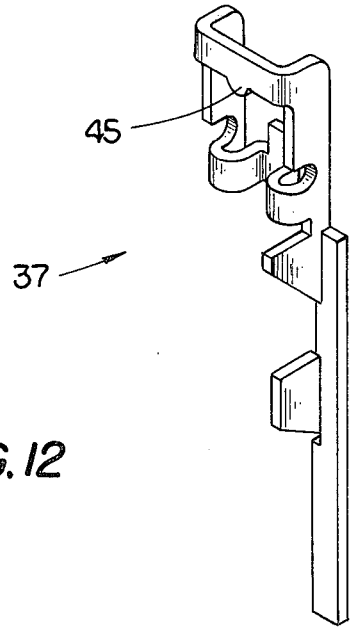
FIG. 12 is a perspective view of a reversing switch comprising a portion of the FIG. 1 and FIG. 7 lifting jacks.

Another design improvement over the prior art lifting jacks and which is typical to both lifting jack 60 and lifting jack 20 is the design of the reversing latch and reversing switch. In the prior art construction, the reversing switch is a fairly basic stamping which is formed into an appropriate shape and contour in order to provide the necessary coacting surfaces for the remainder of the lifting jack. Due to the significant force vectors present at various points in the reversing switch, there has been a tendency for bending and buckling to occur. Since this particular component piece part is very important in that it controls the climbing pins as they go in and out, any damage or susceptibility to damage to this particular piece represents an area of concern regarding the suitability of the design. The new design is much stronger and is produced completely on one die. A perspective view of the new styled reversing switch is illustrated in FIG. 12. As can be seen, the upper portion of this component part is significantly stronger and has a generally U-shaped cross section with both curved inner and outer portions. Also provided by this part is a revised cam design which alternately kicks out the pins with less resistance providing a smoother operation for the lifting jack.

The coacting reversing latch is also redesigned over the prior art construction wherein the prior art involved a single continuous top edge portion which had a relatively small notch disposed therein. This notch coacted with a downwardly projecting curved protuberance disposed in the reversing switch. In the new design, the reversing latch has this top or uppermost edge contoured into two portions. There is a raised outer portion 39 and a recessed inner portion 40 with a curved interface between the two. It is the curved interface which coacts with downwardly directed protuberance 45 for a latching or locking orientation. While this particular portion of the reversing latch has been redesigned, the reversing latch itself has been significantly changed in that in the disclosed invention, this latch is fabricated from a stamping. In the prior art, the reversing latch included an embossment at its pivoting pin location, and its method of fabrication required a significantly greater amount of material whereby a stamping greatly reduces the material requirements and provides an improved part construction.

While the foregoing component piece parts which represent design improvements over the corresponding prior art component piece parts are applicable to both the stamping jack configuration of FIGS. 1–4 as well as the combination jack configuration of FIGS. 7–10, there are certain additional design improvements over the prior art which are unique to only the stamping jack and alternatively, are unique to only the combination jack. Three such component parts which have been redesigned for the stamping jack include the lower runner, the upper runner and the top handle. Although in the prior art, the lower runner was produced from stamping piece parts welded together, there was a requirement for three component pieces to be fabricated and then welded together in order to create the lower runner. These three pieces included a U-shaped member, a bridge member and an angle member. The bridge member was welded directly together to a corresponding substantially flat face of the U-shaped member. There was no other method of attachment or interlock between these pieces other than merely the seam weld. While this method increased part cost, it also resulted in a less-durable design. In the stamping jack arrangement of the present invention, this three-piece construction is improved and simplified into a two-piece construction consisting of a bridge member 96 and a U-shaped member 97 (see FIG. 5). Bridge member 96 is made from an initial stamping and is in fact a combination of the earlier bridge member and the earlier angled member. Once this component piece part is stamped in flat form, it is bent into a uniquely styled contour so as to provide all of the various coacting surfaces necessary for operation of the stamping jack 20.

Figure 5:
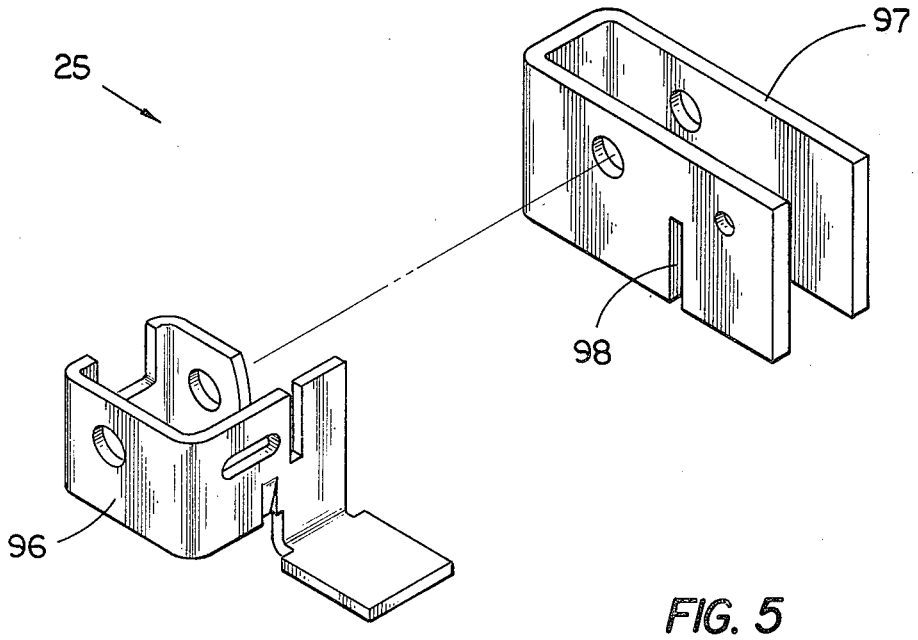
FIG. 5 is a perspective view of a lower runner comprising a portion of the FIG. 1 lifting jack.

The illustration of FIG. 5 is shown in an exploded view format so as to reveal one improved feature of the new component part. This new feature includes a slot 98 which is arranged relative to member 97 for interlocking receipt of a corresponding portion of member 96. By creating such an interlocking concept, these two component piece parts may be manually assembled into their proper respective orientations and then welded in place. Although there are improvements by reducing the piece part number from three to two by this improved design, the strength of the part is greatly increased due to its interlocking assembly concept. While the prior art lower runner included a number of important surfaces and features, all of these have been preserved by the stamping concept which is used for both the bridge member and the U-shaped member.

Turning now to the upper runner 24, it will be appreciated that although this portion of lifting jack 20 is very similar in external appearance to the prior art upper runner, there are certain structural differences. In the prior art construction, the first climbing pin (27) was supported between an outwardly extending bridge member and an inner cylindrical portion welded to the inside frame of this upper runner. The retaining bar which extends through the pin so as to control its depth of insertion, rode on two side edges of this outwardly protruding portion and were otherwise completely exposed. By means of the new design for this upper runner, the outwardly extending bridge member 100 is a stamping with a wrap-around design wherein both an outer and inner surface are provided by the wrap-around formation of the stamping. These two surfaces provide for the guiding of the first climbing pin 27. One side of this member is slotted to receive stop bar 101 of pin 27 and the opposite side is notched. What should be apparent from the illustrations provided is that the bridge member for the upper runner is very similarly styled to the bridge member for the lower runner and this compatibility of appearance, although having a pleasing visual effect, does provide greater strength and rigidity of alignment for the climbing pin. The elimination of the cylindrical member for guiding the pin as found in the prior art construction reduces the amount of material which otherwise had to be eliminated from the bridge in order to provide the necessary clearance and room for welding. With more material being permitted as part of the improved bridge member, its construction is stronger.

An additional change involves the revision of the nose section 47 which is somewhat shorter than the prior art construction and its lowermost portion 102 is formed inwardly and upwardly so as to provide a guiding edge for travel along the standard. In the prior art construction, an additional piece was formed and welded in place at this location in order to provide the necessary guiding surface.

As has been previously mentioned, the top handle 46 has also been revised from the prior art construction and this involes removal of the lower outer corner for a more symmetrical and pleasing design appearance.

Turning now to the combination lifting jack 60 as illustrated in FIGS. 7–10, two of the primary design changes over the prior art construction which have not yet been discussed involve the reconfiguration of the top handle 86 and the upper runner 64. In this combination lifting jack 60, the top handle is fabricated as a casting and has greater thickness than its corresponding top handle member in the stamping lifting jack 20. Although the general shape and configuration differences will be apparent by a comparison of the prior art and the illustrations of FIGS. 7–10, a few of the various changes should be pointed out. One such change involves the fact that the outermost point 105 of top handle 86 is tapered to a somewhat rounded point and the under surface extending across the entire lower exposed edge includes a series of rib-like serrations 106. An inner raised boss portion 107 (see FIG. 10) is arranged to fit within the recessed portion of the I-beam cross-sectional shape of standard 61. This fit between boss portion 107 and the recess portion of standard 61 provides a very rigid and secure relationship between the top handle and the standard. Although these two pieces are additionally bolted together, even a single bolt very tightly threaded in place may give way and allow pivotal slippage to occur. By means of this interlocking construction, the relationship between these two piece parts is firmly fixed. In the prior art arrangement, raised stiffening ribs or linear bosses were provided as part of the interlocking means; but due to the fact that a stamping was employed, these stiffening ribs could not be provided with sufficient height above the inner surface of the top handle so as to provide an extremely positive fit. However, by going to a casting the material thickness of the part is able to be increased so as to provide a much thicker member for the desired interlock with the recessed portion of the standard.

Regarding the revised design of the upper runner for the combination jack, it should be understood that this upper runner is now a one-piece casting throughout and provided as part of this single casting is nose 87, the bridge portion for the first pin 67, and all necessary surfaces and apertures for receipt and coacting operation with the remainder of the lifting jack. By going to a casting fabrication concept, a number of structural and appearance improvements have been made. Certain sharp edges which result from stampings are eliminated and the nose, for example, has a more stylish appearance. The nose is solid throughout and includes a center portion which is substantially thinner than the U-shaped form of the stamping and prior art. The nose has a wide top surface which is curved at its outer tip and includes a series of rib-like serrations across its top surface. The bridge continues to include both an outer supporting face for the first climbing pin as well as an inner supporting opening and this inner opening provides the additional benefits of a stamping with the cylindrical guide-like appearance present in the prior art. By going to a single-piece casting, many of the manual assembly, welding and clean-up steps are eliminated from the fabrication cycle.

While there are benefits as well as disadvantages to either style, whether it be a casting or stamping, the two concepts embodied herein as part of the present invention are both believed to provide a number of benefits and improvements over the prior art construction.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A lifting jack comprising:

a standard having a plurality of spaced apertures;

an upper runner disposed about said standard;

a first climbing pin carried by said upper runner and adapted to fit within said apertures;

a lower runner disposed about said standard;

a second climbing pin carried by said lower runner and adapted to fit within said apertures;

level means pivotally attached to said upper runner for moving said upper runner along said standard;

a pitman pivotally attached at a first end to said lever means and at a second end to said lower runner thereby cooperatively coupling said upper and lower runners together, movement of said upper and lower runners including alternately positioning said first and second climbing pins into said apertures, said pitman being die-formed of a single-piece construction and having a generally U-shaped lateral cross-section configuration and having a narrowing taper from said second end to said first end; and reversing means for changing the direction of movement of said upper and lower runners from a first direction to a second direction opposite to said first direction.

2. The lifting jack of claim 1 wherein said upper runner being fabricated as a single-piece casting.

3. The lifting jack of claim 2 wherein said standard has a generally I-beam lateral cross-sectional configuration and said lifting jack further including a top handle attached to said standard adjacent one end of said standard, said top handle having an inwardly protruding raised boss portion adapted to fit within the recessed side of said standard for fixing the orientation of said top handle relative to said standard.

4. A lifting jack comprising:

a standard having a plurality of spaced apertures;

an upper runner disposed about said standard;

a first climbing pin carried by said upper runner and adapted to fit within said apertures;

a lower runner disposed about said standard, said lower runner is arranged into only two pieces, one piece defining a slot therein and the other piece having a tab portion adapted for interlocking engagement with said slot;

a second climbing pin carried by said lower runner and adapted to fit within said apertures;

lever means pivotally attached to said upper runner for moving said upper runner along said standard;

a pitman pivotally attached at a first end to said lever means and at a second end to said lower runner thereby cooperatively coupling said upper and lower runners together, movement of said upper and lower runners including alternately positioning said first and second climbing pins into said apertures, said pitman being of a single-piece construction and having a U-shaped lateral cross-section configuration; and reversing means for changing the direction of movement of said upper and lower runners from a first direction to a second direction opposite to said first direction.

5. The lifting jack of claim 4 wherein said reversing means includes a reversing switch and a cooperating reversing latch, said reversing switch having a projecting tab, said reversing latch having a coacting top edge wherein approximately half of the top edge is disposed as a raised portion and a remainder of the top edge is disposed as a recessed portion, the interface between said portions being curved and adapted for coacting with said projecting tab.

6. A lifting jack comprising:

a standard having a plurality of spaced apertures;

an upper runner disposed about said standard;

a first climbing pin carried by said upper runner and adapted to fit within said apertures;

a lower runner disposed about said standard;

a second climbing pin carried by said lower runner and adapted to fit within said apertures;

lever means pivotally attached to said upper runner for moving said upper runner along said standard;

a pitman pivotally attached at a first end to said lever means and at a second end to said lower runner thereby cooperatively coupling said upper and lower runners together, movement of said upper and lower runners including alternately positioning said first and second climbing pins into said apertures; and reversing means for changing the direction of movement of said upper and lower runners from a first direction to a second direction opposite to said first direction, said reversing means including a reversing switch and a cooperating reversing latch, said reversing switch having a top portion of a U-shaped lateral cross section and a projecting tab, said reversing latch having a coacting top edge wherein approximately half of said top edge is disposed as a raised portion and the remainder of said top edge is disposed as a recessed portion, the interface between said portions being curved and said projecting tab being adapted for coating with said interface to limit movement of said upper and lower runners to only one direction, said lower runner being arranged into only two pieces, one piece defining a slot therein and the other piece having a tab portion adapted for interlocking engagement with said slot.

7. A lifting jack comprising:

a standard having a plurality of spaced apertures;

an upper unner disposed about said standard;

a first climbing pin carried by said upper runner and adapted to fit within said apertures;

a lower runner disposed about said standard, said lower runner is arranged into only two pieces, one piece defining a slot therein and the other piece having a tab portion adapted for interlocking engagement with said slot;

a second climbing pin carried by said lower runner and adapted to fit within said apertures;

lever means pivotally attached to said upper runner for moving said upper runner along said standard;

a pitman pivotally attached at a first end to said lever means and at a second end to said lower runner thereby cooperatively coupling said upper and lower runners together, movement of said upper and lower runners including alternately positioning said first and second climbing pins into said apertures; and reversing means for changing the direction of movement of said upper and lower runners from a first direction to a second direction opposite to said first direction.

* * * * *